US005334066A

United States Patent [19]

Gerard

[11] Patent Number: 5,334,066

[45] Date of Patent: Aug. 2, 1994

[54] WATER SPORTS APPARATUS

[76] Inventor: Jean-Paul Gerard, 2 rue d'Hallouvry, 35135 Chantepie, France

[21] Appl. No.: 66,006

[22] Filed: May 25, 1993

[30] Foreign Application Priority Data

Nov. 26, 1990 [FR] France ..... 90 14910

[51] Int. Cl.[5] ..... B63C 9/08

[52] U.S. Cl. ..... 441/129; 472/129; 441/130

[58] Field of Search ..... 441/35, 40, 44–46, 441/129, 130, 136; 472/106, 114, 128, 129

[56] References Cited

U.S. PATENT DOCUMENTS 2,829,891 4/1958 Ludwig ..... 272/1
3,004,268 10/1961 Haas ..... 441/46
3,620,529 11/1971 Newman ..... 472/129
3,666,265 5/1972 Ammerman et al. ..... 272/56

FOREIGN PATENT DOCUMENTS 763816 5/1934 France .
1557714 2/1969 France .

*Primary Examiner*—Edwin L. Swinehart
*Attorney, Agent, or Firm*—Ladas & Parry

[57] ABSTRACT

The apparatus comprises a float (1) in the form of a body of revolution, a pair of arms (20) connected to the central portion of the float and extending symmetrically on either side of the float, and a pair of gripping members (31), each of which is accessible by a user (U1, U2) supported on one of said arms (20), whereby two users located opposite each other can impart a rocking movement to the apparatus about the axis of revolution (XX') of the float.

11 Claims, 4 Drawing Sheets

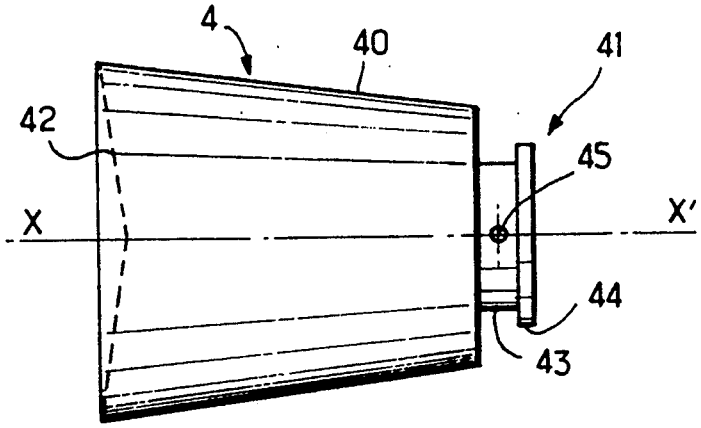
FIG. 5
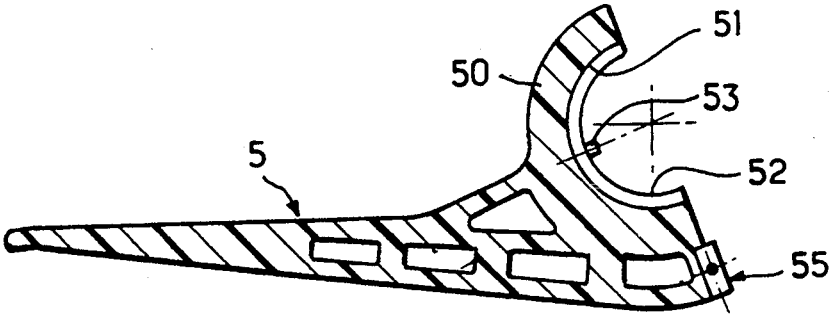
FIG. 6
FIG. 7
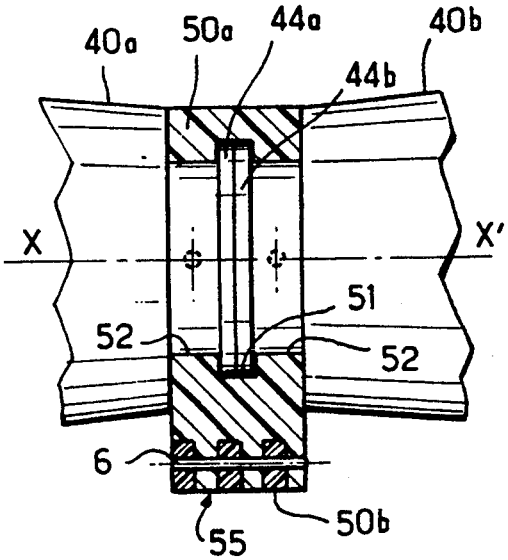
FIG. 8
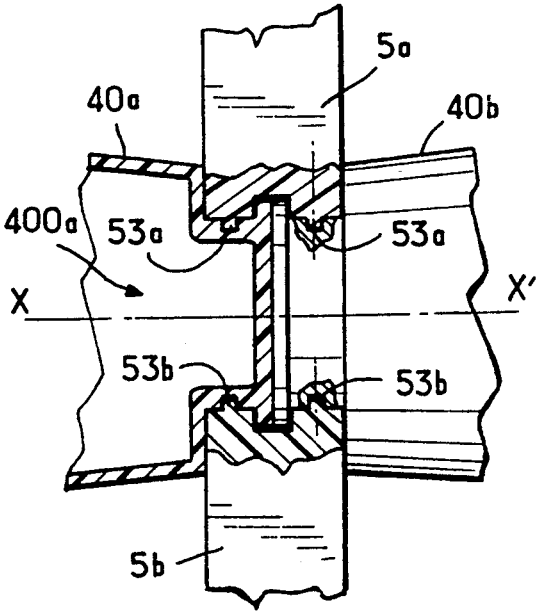

WATER SPORTS APPARATUS

BACKGROUND OF THE INVENTION

1. Field of the Invention

The present invention relates to an apparatus for water sports and more precisely, to an apparatus intended for use by two people, for example, two children.

2. Description of the Related Art

Floating equipment for water sports and exercise have previously been proposed for use by bathers and other users (particularly children) in swimming pools, lakes in leisure parks, and on beaches; such equipment is generally limited in variety.

In this connection can be cited floating boards, buoys, air mattresses or inflatable dinghies, which offer their users extremely limited possibilities for entertainment.

SUMMARY OF THE INVENTION

The aim of the present invention is to fill this gap by proposing a new type of water sports apparatus, allowing two users to develop new exercises and therefore to experience new sensations, for the purposes of entertainment or sport.

The invention further provides an apparatus which is simple to use, which provides the necessary safety for the users and which is moderately priced.

To this end, the apparatus according to the invention comprises:

- a float which is capable of supporting two users afloat on the surface of the water, this float being in the form of a body of revolution;
- a pair of arms connected to the float and extending symmetrically on either side of the float in a direction substantially perpendicular to its axis of revolution;
- a pair of gripping members each of which is accessible to one user as he rests against one of said arms;
- this arrangement allowing two users facing one another on the apparatus to impart a rocking motion to the apparatus about said axis of revolution.

Moreover, in accordance with a number of advantageous but non-limiting features:

- the upper surface of each arm is substantially flat and smooth;
- the two arms form a V-shape of obtuse angle, the open part of the "V" being towards the top and the angle of the "V" advantageously lying in the range 120° to 150° and preferably of the order of 134°;
- the gripping members are situated at the two ends of a flexible strap, for example a rope, which passes around the float;
- the gripping members comprise handles carried on a bar hinged to the float;
- the float has the general shape of a diabolo bobbin;
- the float is constituted by two identical hollow elements which are joined and secured end to end;
- connection of these two elements is provided by the two arms themselves, the latter having half-shell portions which are secured to each other by squeezing them together and gripping between them the adjacent parts of the two hollow elements forming the float;
- these hollow elements are made of plastic and fabricated by rotation molding.

Other features and advantages of the invention appear in the description and the accompanying drawings which present preferred embodiments.

BRIEF DESCRIPTION OF THE DRAWINGS

FIG. 5 is front view of an element constituting one possible embodiment of a two part float;

FIG. 6 is a longitudinal section through one possible embodiment of an arm;

FIGS. 7 and 8 are detail views showing the method of connecting the two elements constituting the float according to FIG. 5, using a pair of arms according to FIG. 6, these being partially cut-away views from the front and from above respectively;

DESCRIPTION OF THE PREFERRED EMBODIMENTS

Figure 1:
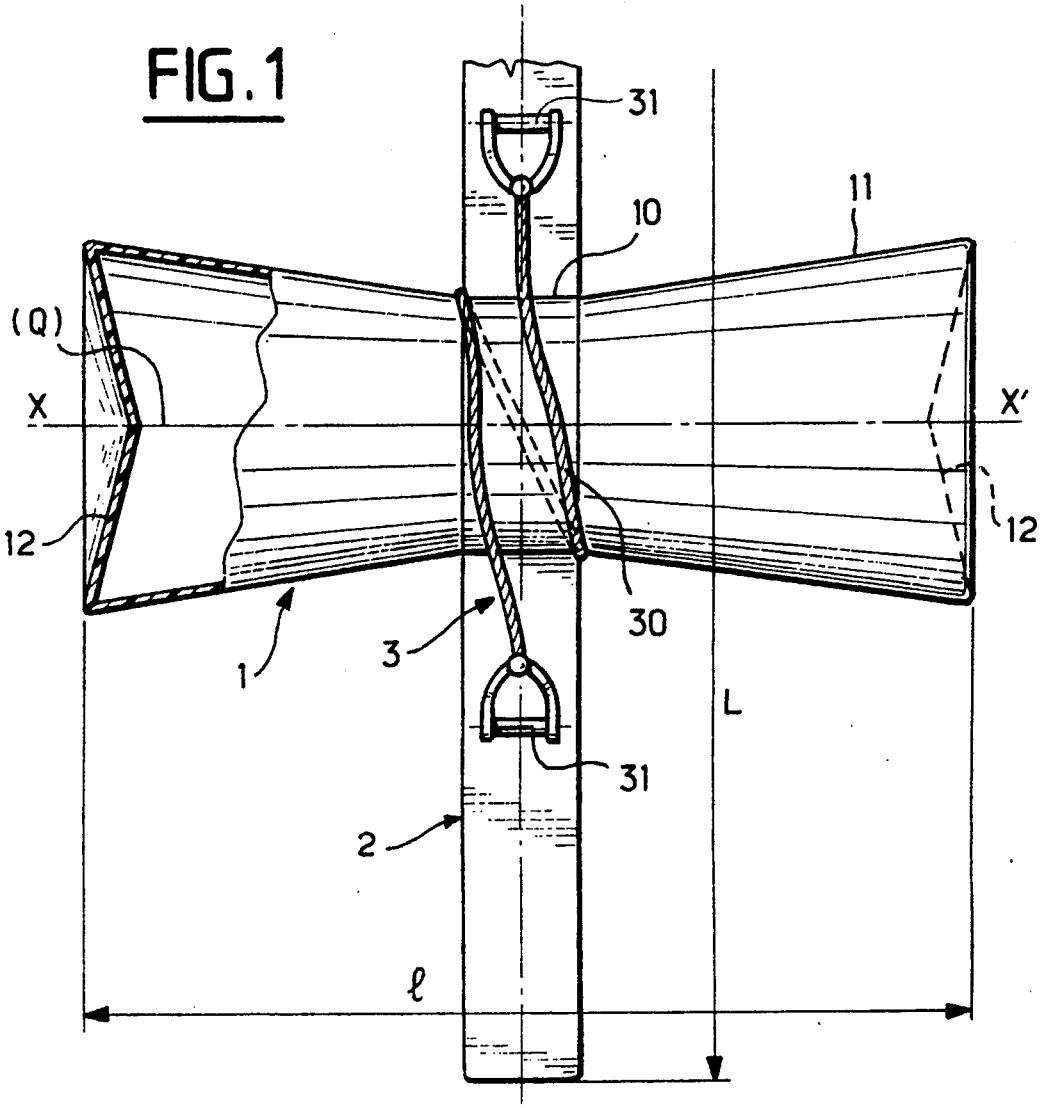
FIG. 1 is a part section view from above of a preferred embodiment of the apparatus according to the invention.
Figure 2:
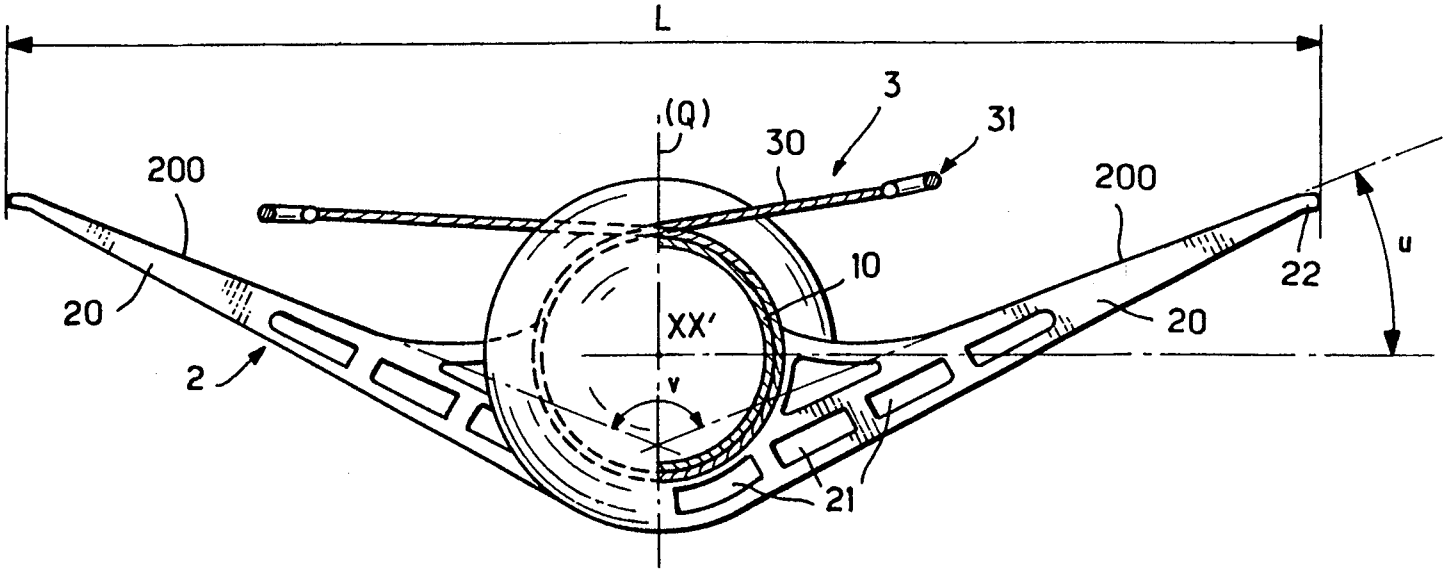
FIG. 2 is a partly cut-away side view on a median transverse plane, of the apparatus of FIG. 1.

The apparatus shown in FIGS. 1 and 2 comprises a float designated by reference 1. This float is a hollow body of plastics material which has the general form of a diabolo bobbin, comprising a central cylindrical portion 10 connected to two truncated cones 11 which flare towards their ends. The float therefore comprises a body of revolution whose axis is designated by XX' in FIG. 1. By way of example, the height 1 of the body 1 is of the order of 1.25 meters(m). The diameter of the truncated cones 11 increases from 0.35 m (small base) to 0.50 m (large base).

Preferably, the large bases are recessed towards the inside of the float by conical dishes 12.

Outriggers 2 are secured to the central portion of float 10, the outriggers being constituted by a pair of identical arms 20 which extend in a direction perpendicular to axis XX' and which are symmetrical on either side of the vertical plane of symmetry Q of the float. The width of these arms 20 is approximately constant and their thickness decreases slightly from the float towards their ends, so as to constitute beams of substantially constant bending strength over their entire length.

The upper surface 200 of each arm 20 is substantially flat and smooth over most of its length. The surfaces 200 are, however, smoothly connected by rounded zones to the portion 10 of the float.

In accordance with a significant characteristic of the invention, each of the surfaces 200 forms an acute angle u with a horizontal plane (a plane perpendicular to plane Q), this angle lying in the range from 20° to 25° and preferably of the order of 23°. Consequently, the obtuse angle v formed between the surfaces 200 of the two arms 20, which surfaces form a "V" whose opening is directed upwardly and whose apex is at the bottom and substantially below the axis XX', lies in the range from 120° to 150°, and is preferably of the order of 134°.

Preferably, the free ends 22 of the arms 20 are turned slightly downwards towards the horizontal and have rounded edges so as to prevent injury.

Finally, arms 20 are provided with suitable apertures or slots 21 to reduce weight.

By way of example, the span—i.e. the distance between the ends 22 of the two arms, designated L in the figures—is about 1.90 m.

The weight and dimensions of the assembly constituted by the float 1 and the outriggers 2 are determined so that it can support afloat at least a pair of users. Clearly, if the apparatus is intended more particularly for children, the dimensions may be smaller than if it is intended for adults.

The apparatus also comprises gripping means 3. This consists of a flexible strap 30, such as a small cord, each end of which is provided with a handle 31. The flexible strap 30 is merely wrapped around the central portion 10 of the float; it can slide freely on the float if it is pulled by either of the handles.

Figure 3:
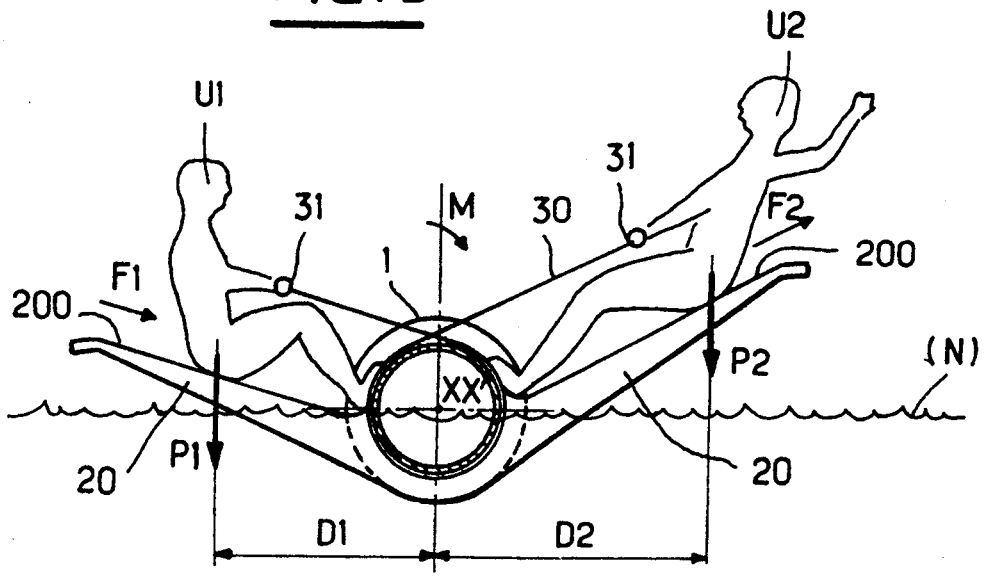
FIGS. 3 and 4 are similar views to that of FIG. 2, showing the principle of operation of the apparatus.
Figure 4:
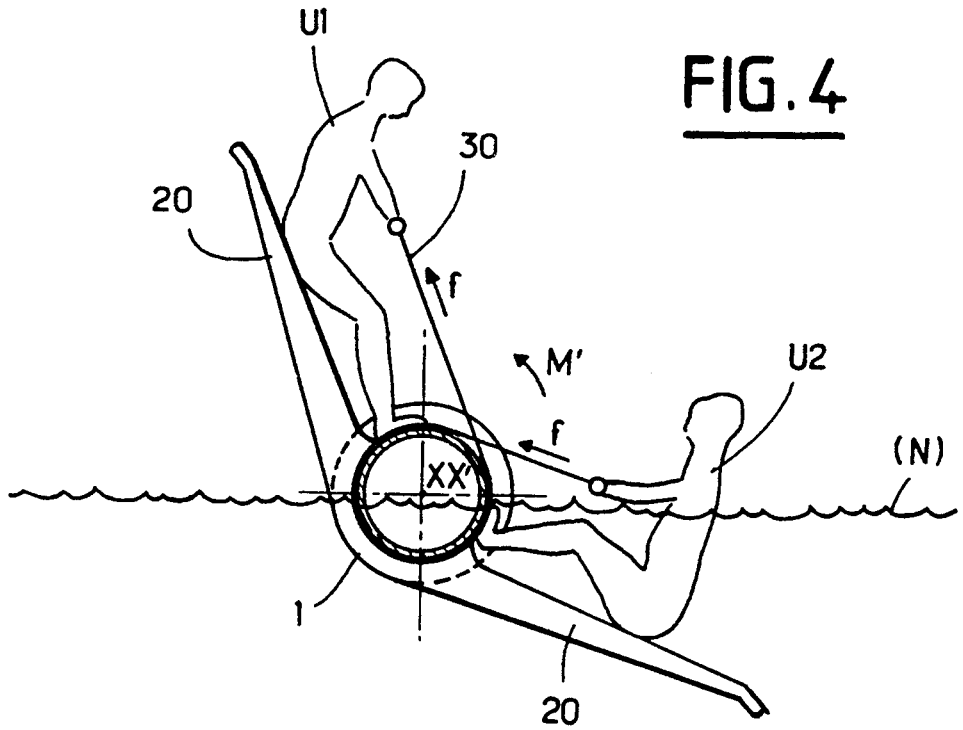

FIGS. 3 and 4 show the operation of the apparatus carrying a pair of users designated U1 and U2.

The apparatus is placed in water whose surface is designated N. Each user U1, U2 sits on one of the two arms 20 so that his feet push against the float. The two users are therefore situated opposite one another so that they are looking at each other, and each user grips one of the two handles, using both hands or just one hand.

Preferably, the mass of the apparatus is designed so that the level at which it floats passes near the axis XX', for example, just below it.

Each user, sitting on the upper surface 200 of one of the arms 20, exerts a turning moment on the apparatus which tends to rock it about axis XX', downwards on the user's side.

P1 and P2 in FIG. 3 designate the respective weights of the users U1 and U2, and D1 and D2 respectively designate the leverage of P1 and P2 about the axis XX'.

Each user can vary the respective distance D1, D2 by sliding in one direction or the other along the smooth flat surface 200. Thus, arrows F1 in FIG. 3 show the movement of user U1 who bends his knees to move closer to the float and arrows F2 show the movement of user U2 who, by contrast, moves away from the float by stretching his legs. These two movements take place in conjunction with one another and in synchronism, thanks to the strap 30 which remains taut and acts essentially as a device for transmitting motion between U1 and U2. Distance D2 therefore becomes substantially greater than distance D1. Consequently, assuming that the weights P1 and P2 are similar, the resulting moment designated as M tends to rock the apparatus in a certain direction, which is clockwise in FIG. 3.

Rocking of the apparatus about axis XX' causes the user U2 to find himself partly immersed, whereas user U1 finds himself lifted completely out of the water, in an almost vertical position (see FIG. 4).

When user U2 finds himself partly immersed, an upwardly-directed force is exerted on him which corresponds to the Archimedes force and which tends to push him back out of the water.

At the same time, user U1 extends his legs by pulling on the cord 30 (as shown by arrows f in FIG. 4). The point at which U1 is supported is therefore displaced towards the end of his support arm 2, whereas the zone at which U2 is supported on his arm becomes closer to XX'.

A restoring moment M' is therefore produced which is opposite to the previous moment and which causes the apparatus to rock in the opposite direction.

It is therefore easy for two users with a minimum of experience to impress alternate rocking movements on the apparatus in one direction and then in the other direction, by altering the positions at which they are supported on their arms and by pulling on the cord 30 (or by paying out the cord) so as to co-ordinate their movements.

The pleasure of the game is increased due to the fact that the users can immerse themselves in the water to a greater or lesser extent during their rocking, and also due to the influence of the Archimedes force, which is novel for open-air see-saws.

There are of course various different methods by which the arms 20 can be connected to the float 1.

Because of the relatively large size of the apparatus, it is very desirable in all these different methods that this connection should be easily demountable, so as to facilitate transporting the apparatus.

FIGS. 5 to 8 illustrate a quick and easy method of assembling the apparatus.

The float is formed of two identical elements (half-floats), one of which, indicated by reference 4, is shown in FIG. 5. This element is a watertight hollow body, in the general shape of a truncated cone, preferably manufactured by the rotation molding technique.

Reference 40 designates the truncated conical surface of element 4 and reference 42 designates its large base, which is formed with a cavity in the form of a dish.

Portion 41 which corresponds to the small base is formed with a cylindrical neck 43 connected to a disc-shaped shoulder 44. Part 43 is provided with two diametrically-opposed blind bores 45.

To produce a float, two identical elements 4 are joined co-axially via their shoulders 44 and secured to each other by a demountable connection.

Advantageously, this connection is made using the arms which constitute the outrigger 2.

These arms are of a molded plastics material.

FIG. 6 shows such an arm, indicated by reference 5. The arm has a semi-cylindrical portion 50 in the form of a half-shell. Portion 50 has a central semi-cylindrical yoke 51 suitable for accommodating the two shoulders 44*a*, 44*b* of two elements 4 to be joined (see FIGS. 7 and 8).

On either side of the central half-yoke 51 are two half-yokes 52 of smaller diameter, corresponding to the parts 43 of the elements 4. Each of these half-yokes 52 carries a radial stud 53 which can fit in a blind bore 45 of the element 4.

Indices a and b in FIGS. 7 and 8 have been assigned to the reference numerals relating to one or other of the two elements 4 constituting the float. As clearly seen from these figures, the portions 50 of the two arms act like the two halves of a shell to surround and confine the portions 41 of each element. Correct positioning of each arm 5*a*, 5*b* relative to the float is obtained by engaging the studs 53 in the holes 45.

The lower part 55 of each arm 5 has a profile in the form of a staggered joint comprising raised portions acting as tenons alternating with hollows acting as mortises. When the two arms are correctly positioned around the portions 41 of the float, the joints of the two arms intermesh, the connection being completed by a keeper pin 6 (see FIG. 7).

An assembly of the two arms 5 and the two parts of the float 4 is thereby obtained which is easily and rapidly demountable.

Moreover, as the apparatus is composed of two identical float elements 4 and likewise two identical arms 5, the cost price of the assembly is relatively modest.

Figure 9:
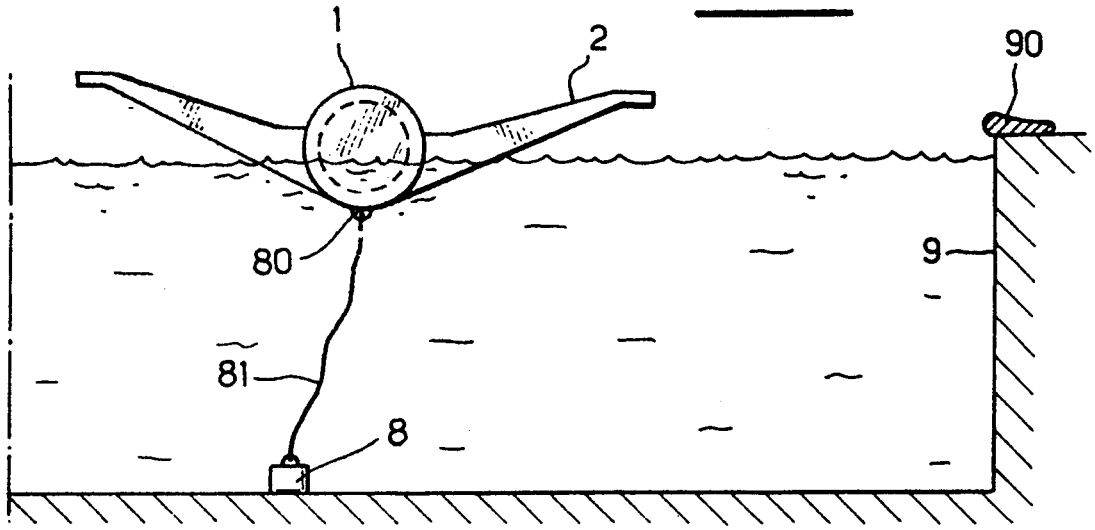
FIG. 9 is a general view showing a possible means of mooring the apparatus in a lake.

FIG. 9 shows an apparatus according to the invention, placed in water such as a swimming pool 9 having a peripheral lip 90.

It may occasionally be awkward if, the apparatus should move towards the edge of the swimming pool while in use and get too close to that edge. There may then be a risk that a user bumps against the lip 90, particularly if the users are children.

For this reason, it may be advantageous to moor the apparatus; this may be done using a rope 81 attached at one end to a suitable eyelet 80 provided on the float 1, the other end of the rope being attached to a weight 8.

The weight may either rest on the bottom as shown (leaving some slack in the rope), or it may be suspended in the waters (in which case the length of the rope is less than the depth of the water). In the latter case, the presence of the weight damps the oscillations of the apparatus.

Figure 10:
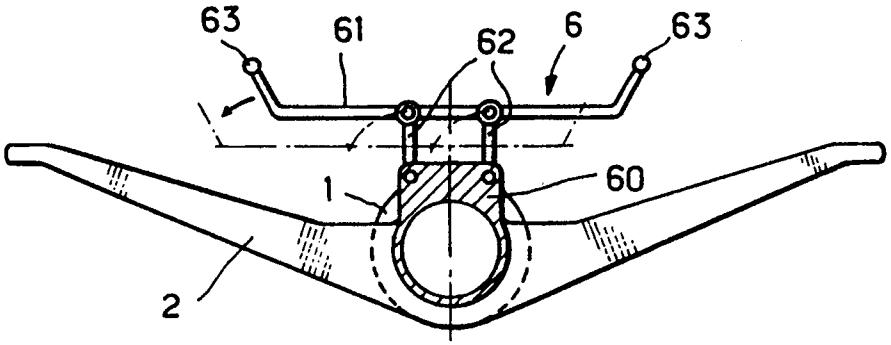

In the variant shown in FIG. 10, the gripping system 6 is comprised, not of a flexible strap, but of a transverse connecting bar 61 having at each end a gripping means 63, such as a T-shaped handle. Small rods 62 allow the bar 61 to be hinged on a mounting 60 integral with the float.

By pivoting the small rods, as indicated by the arrow in FIG. 10, bar 61 can be moved along the arc of a circle towards one or other of the two arms. As was the case with the flexible strap, each user can therefore act upon the other user via the gripping means.

It is of course possible for the float to comprise different shapes of revolution.

Figure 11:
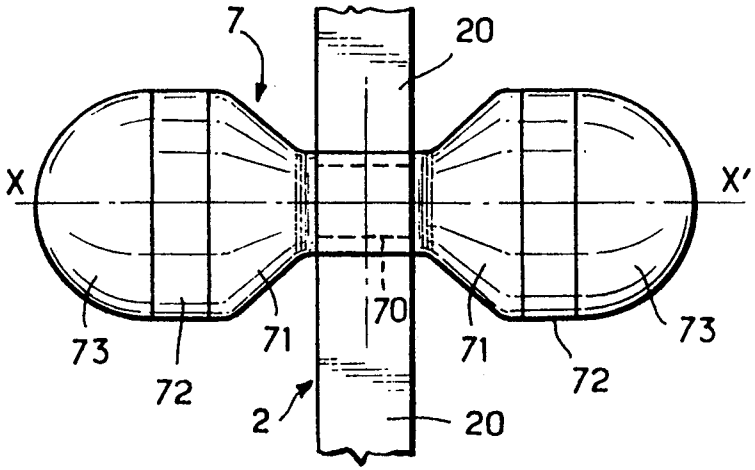
FIGS. 10 and 11 are schematic views from the side and from above respectively, of two possible variants of the apparatus.

In the variant shown in FIG. 11, the float reference numeral 7—has a cylindrical central portion 70 of small diameter which carries the arms 20 of the outrigger 2. The central cylindrical portion 70 is connected to two cylindrical hoops 72 of larger diameter, via truncated conical portions 71. The hoops 72 are themselves connected at their outer sides to hemispherical parts 73.

Other shapes may be envisaged. The only limitation is that the float should have an axis of revolution XX', which serves as an axis about which the apparatus rocks, and that the shape of the float should confer good stability on the apparatus, which implies that the ends of the float should be larger in diameter than the central portion which carries the arms of the outrigger.

Finally, as mentioned earlier, the value of the previously-defined angle u, which corresponds to the angle of inclination of the arms with respect to the horizontal, has considerable significance. If this angle is too large, in this case above about 25°, the users have difficulty maintaining the correct sitting position on the apparatus during its use. On the contrary, if the angle u is too small, in this case below about 20°, then the users cannot move fast enough along the support arms, which leads to difficulty in working the apparatus.

I claim:

1. Apparatus for water sports comprising:

a float (1, 7) capable of supporting two users (U1, U2) afloat on the surface of the water, said float being in the form of a body of revolution, said body having a central cylindrical portion connected to two end portions, each of said end portions having a larger diameter than the central portion;

a pair of arms (20) connected to the float (1, 7) and extending symmetrically on either side of the float in a direction substantially perpendicular to its axis of revolution (XX');

a flexible strap which passes around the float, said strap having two ends, and a gripping member at each end of the flexible strap.

2. Apparatus according to claim 1, characterized in that the upper surface (200) of each arm (3) is substantially flat and smooth.

3. Apparatus according to claim 1, characterized in that the two arms (20) form a V-shape of obtuse angle, the open part of the "V" being towards the top.

4. Apparatus according to claim 3, wherein the angle (v) between the two arms (20) is in the range of 120° to 150°.

5. Apparatus according to claim 1 wherein the flexible strap (3) can slide on the float (1).

6. Apparatus according to claim 1, characterized in that said float is constituted by two identical hollow elements (4) which are joined and secured end to end.

7. Apparatus according to claim 6, wherein the two hollow elements (4) are joined and secured by the arms (20), the arms having half-shell portions (50) which are secured to each other by squeezing them together and gripping between them the adjacent portions (41) of the two hollow elements (4).

8. Apparatus according to claim 7, characterized in that said hollow elements (4) are made of plastic and fabricated by rotation molding.

9. Apparatus according to claim 1 wherein each of said end portions is a truncated cone (11) which flares towards its end.

10. Apparatus according to claim 1, further comprising a mooring means said mooring means comprising a rope attached at one end to an eyelet (80) on the float and at the other end to a weight (8).

11. Apparatus according to claim 4 wherein the angle (v) between the two arms is 134°.

* * * * *

UNITED STATES PATENT AND TRADEMARK OFFICE

CERTIFICATE OF CORRECTION

PATENT NO. :5,334,066

DATED :August 2, 1994

INVENTOR(S) :Jean-Paul Gerard

It is certified that error appears in the above-identified patent and that said Letters Patent is hereby corrected as shown below:

On title page, left column, before "Filed:" insert -- PCT-- and change "May 25, 1993" to -- November 26, 1991 [86] PCT No.: PCT/FR91/00939 371 Date: May 25, 1993 102(e) Date:May 25, 1993 [87] PCT Pub. No.: WO92/09348 PCT Pub. Date: June 11, 1992--.

Signed and Sealed this

Seventeenth Day of January, 1995

*Attest:*

*Attesting Officer*

BRUCE LEHMAN

*Commissioner of Patents and Trademarks*